US005238114A

United States Patent [19]

Irozuru

[11] Patent Number: 5,238,114

[45] Date of Patent: Aug. 24, 1993

[54] STRAND PACKAGES

[75] Inventor: Ukachi Irozuru, Amarillo, Tex.

[73] Assignee: Owens-Corning Fiberglas Technology, Inc., Summit, Ill.

[21] Appl. No.: 866,710

[22] Filed: Apr. 10, 1992

[51] Int. Cl.[5] ..... B65D 55/02

[52] U.S. Cl. ..... 206/410; 242/170; 242/172; 229/87.01

[58] Field of Search ..... 206/398, 400, 401, 410, 206/389, 497; 229/87.01; 242/170, 171, 172

[56] References Cited

U.S. PATENT DOCUMENTS 3,660,958 5/1972 Garrison ..... 206/410 X
3,915,301 10/1975 Gray et al. ..... 206/410 X
4,220,295 9/1980 Green et al. ..... 242/170
4,300,734 11/1981 Green et al. ..... 206/410 X
4,460,086 7/1984 Davis ..... 206/410 X
4,467,916 8/1984 Hedden et al. ..... 206/410
4,493,464 1/1985 Green et al. ..... 242/170
5,147,040 9/1992 Koike ..... 206/410

*Primary Examiner*—Jimmy G. Foster
*Assistant Examiner*—Ted Kavanaugh
*Attorney, Agent, or Firm*—Ted C. Gillespie; Patrick P. Pacella

[57] ABSTRACT

A package having a stretch membrane convolutely position about an unwindable wound body of strand where a tacky surface of the membrane contacts the outer layer of strands. The tacky surface also interlocks multiple layers of the membrane together.

8 Claims, 1 Drawing Sheet

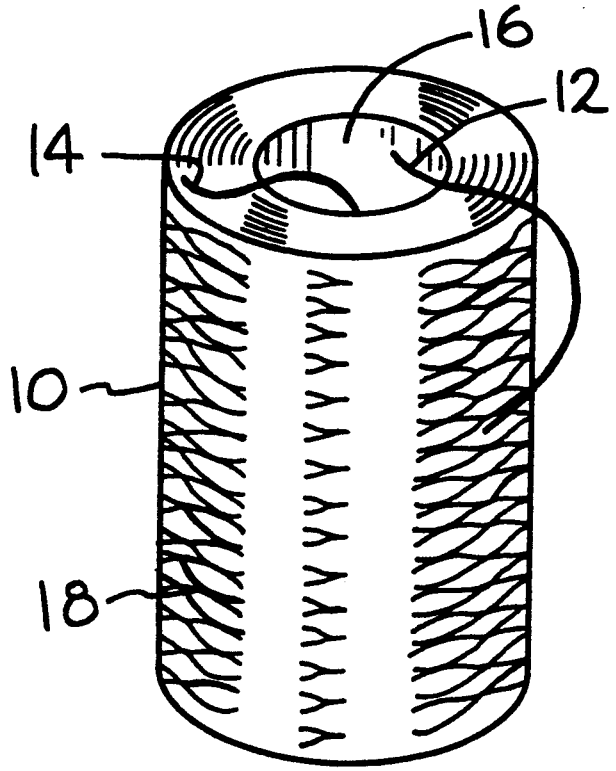
16
12
14
10
18

STRAND PACKAGES

TECHNICAL FIELD

This invention relates to a package of unwindable strands.

BACKGROUND ART

Packages for filaments, strands, or rovings of continuous glass fibers are numerous. The packages facilitate unwinding of the strand from the package and minimize related processing problems. The packages typically are a membrane surrounding wound strands. One package incorporates an adhesive between the membrane and outer layer of strand to retain the strand against the inner wall of the membrane. Often, however, the adhesive peels off the film. The adhesive then contaminates the strand rendering it useless for reinforcing plastics. Other packages used shrink film as the membrane. Heat shrinkable film allows the membrane to adhere to the outer periphery of the package to an extent sufficient to retain the strand in contact with the membrane until the strand is substantially completely withdrawn from the package.

All of these packages found wide acceptance in industry. However, at temperatures above 90° F. the exterior membrane in which the package is wrapped tends to relax with the result that the strand being withdrawn tends to birdnest and become entangled in a guide eye.

DISCLOSURE OF THE INVENTION

I have improved the film package concept even further by employing a stretch film which is tacky on the outside. By reverse winding the package, the tacky side holds the outside layer of strands. By using 2 or more layers of film, the tacky side also holds the package together to give the necessary support for complete unwinding of the strands. This differential cling eliminates the need to heat the stretch film. My packaging is a stretch film and it does not shrink.

The tacky side of the film holds the roving for 100% runout and holds the strand and for excellent package to package transfer. An overwrap machine applies three to five wraps of one sided tacky stretch film to each package. The tacky side of the film directly contacts the strands. Preferably, the stretch film is a linear low density polyethylene with a true one sided (outside) differential cling. The tack in my film is a part of the film and does not peel off as an adhesive would.

BRIEF DESCRIPTION OF THE DRAWING

The FIGURE is an isometric view of a cylindrical package of coiled continuous strands.

The package 10 of glass filaments shown in the FIGURE consists of a continuous glass roving wound in successive layers of coils to form a generally cylindrical tubular shape. The continuous roving has a free end 12 on the exterior of the wound package 10, and an internally exposed free end 14 which can be pulled to unwind the package from the inside. The package 10 has generally parallel inner 16 and outer 18 cylindrical surfaces.

As shown in the FIGURE, the roving is wound in successive layers with the roving in each layer being in side-by-side relationship, to provide a package having generally flat annular end surfaces perpendicular to the inner and outer surfaces. This square ended cylindrical package is a particularly economical and otherwise suitable configuration for the packaging of continuous glass fibers, especially glass rovings used in the reinforcement of plastics. However, some coiled packages have an outer surface having a gradual taper in one or both axial directions. The inner surface may also have a slight draft to facilitate removal from a winding drum.

DETAILED DESCRIPTION OF THE INVENTION

While the preferred embodiment of this invention pertains to continuous glass fiber rovings, this invention pertains to any wound body of strand from which the strand is withdrawn from the interior of the body. Such bodies can comprise natural or synthetic fibers, organic fibers or mineral fibers of any length, diameter or quality. Such packages are generally formed by winding a continuous strand on a rotatable collet to form a hollow core package from which the strand is pulled out through the opening formed by the position occupied by the rotating collet.

The package can be of any size and shape. Because such packages wound on a collet, they will generally be cylindrical in shape. The outer periphery of the wound body usually develops a plurality of undulations, or ridges, of irregular height which act to adhere to the outer wrap and, hence, to preserve the cylindrical shape of the package as it is being unwound.

The use of a stretch film herein is in contrast to the frequent use of shrink films to wrap food-stuffs. Shrink film packaging involves the use of thermoplastic films that have been stretched or oriented during manufacturing and have the property of shrinking during the application of heat. Shrink film is normally applied loosely because it does not stretch well at room temperatures.

Stretch film involves the use of thermoplastic film that has been specially formulated to easily stretch at room temperatures. Stretch film is normally produced in thickness ranging from 0.7 mils to 1.5 mils.

The membrane can be wrapped around the package in any number of convolutions, or portion thereof, and can be of any suitable thickness, for example, within from about 0.7 mil to about 1.35 mil, preferably from about 0.8 to about 1 mil. Applying the film under tension holds the film in position during formation of the package.

The wound body of strand can be encased fully or partially within the membrane. Preferably, the membrane will be positioned in contact with the entire longitudinal surface of the package although the membrane can extend over any portions of the ends of the package. The membrane can be wound on the package of strand by any suitable means and at any time after the formation of the package.

The one sided tacky film may be blown or cast, with blown film being preferred.

Both blown and cast film processes melt resin pellets (extrude) through basically the same method. They use a screw which conveys, compresses and pumps the resin through the extruder chamber to the die opening. Each process uses a different shaped die. The cast uses a flat or slot shaped die which forms a single flat sheet of film. The blown uses a circular die which forms a tube of film. These differences in die geometry are due to the process itself and they affect the films orientation. In the blown process film is oriented in an upward direction (machine) and an outward direction (cross/- transverse). Whereas cast film is only oriented in the machine direction.

The next major process difference is the way in which the blown molten polymer (plastic) is cooled. Blown film is cooled by an air ring which surrounds a tube with cooler air. Whereas the cast film is cooled by chilled rolls—temperature is controlled internally with chilled water. Another processing differences is the temperature the molten polymer is at—cast 450°-600° F. vs. blown 350°-45° F. This is due to the different resin types used in each process.

The resins used in blown film have a higher molecular weight (the size of the molecule in relation to process. The lower the molecular weight the higher the melt index. (the flow characteristics of polymer at a certain temperature and pressure) therefore, the blown film resins have a lower melt index which allows it to stretch in both directions with greater strength than cast. These things combine to allow blown film to achieve greater levels of load retention and overall strength at higher levels of stretch than cast film. The blown film process uses a resin with a higher viscosity (lower melt index) than the cast film process.

The film has the ability to adhere to itself. This is necessary to interlock layers of film to one another and to secure the film to the package. The film has one-sided cling—only one side of the film contains a tackifier.

INDUSTRIAL APPLICABILITY

Preferably, the stretch film is a linear low density polyethylene blend with a true one sided (outside) differential cling. This thermoplastic is an extra strong, blown film. It has outstanding coil-cling properties that allow packaging at temperatures down to 0° F. Differential cling means the film has high cling on one side and virtually no cling on the other.

An overwrap machine applies three to five layers of film to each package. Because of the type of stretch film I use, no heating is necessary to shrink the package.

The wrapping operation runs at room temperature down to 0° F. The resulting package provides 100% runout and holds the strand for excellent package to package transfer.

The preferred film comes in rolls of standard lengths and widths (typically 6000 feet by 20 feet) and has the following properties:

| | |
|---|---|
| gauge (mils) | 0.8 |
| manufacturing process | blown |
| tensile strength (p.s.i.) | 6800 |
| cling (lbs./in.) | 2.5 |
| use temperature range (°F.) | 0-120 |

I claim:

1. A package comprising:
(a) a wound body of strand;
(b) a stretch thermoplastic material membrane convolutely positioned about the wound body, the membrane having two surfaces and being treated such that the thermoplastic material provides high cling on one surface and virtually no cling on the other;
(c) the wound body of strand having an outer layer of strand;
(d) the surface of the membrane with high cling being in direct contact with the outer layer of strand; and
(e) multiple layers of membrane surrounding the wound body with the surface of the membrane having no cling on the outside of the package.

2. A package according to claim 1 wherein the thermoplastic material membrane is a blown thermoplastic.

3. A package according to claim 2 wherein the membrane is linear low density polyethylene.

4. A package according to claim 3 where an adhesive is incorporated into the membrane surface having high cling.

5. A package comprising:
(a) a cylindrical body of coil continuous strands;
(b) a blown thermoplastic, stretch membrane convolutely wound about the cylindrical portion of the body;
(c) the cylindrical body having an outer layer of strands;
(d) the thermoplastic providing a tacky surface, the tacky surface being in contact with the outer layer of strands;
(e) the thermoplastic providing an outer surface which is essentially tack free; and
(f) multiple layers of the membrane surrounding the body of strands; and
(g) the tacky surface adhering to the tacky free surface interlocking the multiple layers of the membrane.

6. A package comprising:
(a) a body of continuous, glass fiber strands;
(b) a blown, linear low density polyethylene material stretch membrane convolutely wound about the body of strands;
(c) the body having an outer layer of strands;
(d) the membrane being treated such that the linear low density polyethylene provides tacky surface in contact with the outer layer of strands and the linear low density polyethylene provides an outer surface which is essentially tack free; and
(e) at least 2 layers of membrane surrounding the body of strands; and
(f) the tacky surface adhering to the tack free surface interlocking the layers of membrane.

7. A package according to claim 6 wherein an adhesive is a part of the tacky surface of the membrane.

8. A package according to claim 6 wherein 3 to 5 layers of the membrane surround the body of strands.

* * * * *